US007886720B2

(12) United States Patent
Graf

(10) Patent No.: US 7,886,720 B2
(45) Date of Patent: Feb. 15, 2011

(54) METHOD FOR OPERATING A FUEL PUMP

(75) Inventor: Rolf Graf, Speyer (DE)

(73) Assignee: Continental Automotive GmbH, Hannover (DE)

( * ) Notice: Subject to any disclaimer, the term of this patent is extended or adjusted under 35 U.S.C. 154(b) by 0 days.

(21) Appl. No.: 12/066,204

(22) PCT Filed: Sep. 7, 2006

(86) PCT No.: PCT/EP2006/066128

§ 371 (c)(1),
(2), (4) Date: Mar. 7, 2008

(87) PCT Pub. No.: WO2007/031463

PCT Pub. Date: Mar. 22, 2007

(65) Prior Publication Data

US 2008/0245343 A1 Oct. 9, 2008

(30) Foreign Application Priority Data

Sep. 13, 2005 (DE) ..... 10 2005 043 817

(51) Int. Cl.
*F02M 37/04* (2006.01)
*F04B 17/00* (2006.01)
*F04B 35/04* (2006.01)

(52) U.S. Cl. ..... 123/497; 123/495; 417/410.1; 417/423.3

(58) Field of Classification Search ..... 123/497, 123/357, 487, 255, 495, 499; 417/410.1, 417/423.3
See application file for complete search history.

(56) References Cited

U.S. PATENT DOCUMENTS

| | | | | |
|---|---|---|---|---|
| 3,631,843 | A * | 1/1972 | Yeiser et al. | 123/25 L |
| 4,508,077 | A * | 4/1985 | Shimbara | 123/357 |
| 4,951,636 | A | 8/1990 | Tuckey et al. | 123/497 |
| 4,959,604 | A * | 9/1990 | Cuesta | 320/164 |
| 5,207,520 | A * | 5/1993 | Tanaka | 400/279 |

(Continued)

FOREIGN PATENT DOCUMENTS

DE 40 02 433 A1 9/1990

(Continued)

*Primary Examiner*—Stephen K Cronin
*Assistant Examiner*—Raza Najmuddin
(74) *Attorney, Agent, or Firm*—King & Spalding L.L.P.

(57) ABSTRACT

In a method for operating a fuel pump in order to guide fuel from the fuel container of an internal combustion engine, the electric energy, which is in the form of pulses, is periodically guided to the fuel pump and the duration of the pulses is controlled according to the fuel required by the internal combustion engine. The frequency of the pulses is controlled in such a manner that, in the event of low pump rate of the fuel pump, the frequency is controlled to a higher level than in the even of a high pump rate.

21 Claims, 1 Drawing Sheet

U.S. PATENT DOCUMENTS

| | | | | |
|---|---|---|---|---|
| 5,237,975 | A | 8/1993 | Betki et al. | 123/497 |
| 5,265,644 | A | 11/1993 | Tuckey | 137/510 |
| 5,477,833 | A | 12/1995 | Leighton | 123/497 |
| 5,505,180 | A * | 4/1996 | Otterman et al. | 123/497 |
| 5,542,395 | A * | 8/1996 | Tuckey et al. | 123/497 |
| 5,555,872 | A * | 9/1996 | Takeuchi et al. | 123/497 |
| 6,674,260 | B1 * | 1/2004 | Harriman et al. | 318/599 |
| 6,674,962 | B2 * | 1/2004 | Nadeau | 388/804 |
| 6,808,168 | B2 * | 10/2004 | Muramatsu et al. | 267/140.13 |
| 6,820,596 | B2 * | 11/2004 | Namari et al. | 123/501 |
| 7,185,634 | B2 * | 3/2007 | Gardner et al. | 123/446 |
| 7,406,946 | B1 * | 8/2008 | Watanabe et al. | 123/470 |
| 2001/0013334 | A1 | 8/2001 | Tanaka et al. | 123/406.47 |
| 2002/0148445 | A1 | 10/2002 | Doane et al. | 123/458 |
| 2008/0230035 | A1 * | 9/2008 | Inoue | 123/497 |

FOREIGN PATENT DOCUMENTS

| | | | |
|---|---|---|---|
| DE | 43 02 383 | A1 | 8/1993 |
| DE | 43 17 751 | A1 | 12/1993 |
| DE | 43 35 866 | A1 | 4/1994 |
| DE | 101 46 068 | A1 | 4/2003 |
| JP | 58-172984 | A * | 10/1983 |
| JP | 59077069 | A * | 5/1984 |
| JP | 04358683 | A * | 12/1992 |
| JP | 2004-350443 | A * | 12/2004 |
| WO | WO 92/20915 | A1 | 11/1992 |

* cited by examiner

METHOD FOR OPERATING A FUEL PUMP

CROSS-REFERENCE TO RELATED APPLICATIONS

This application is a U.S. national stage application of International Application No. PCT/EP2006/066128 filed Sep. 7, 2006, which designates the United States of America, and claims priority to German application number 10 2005 043 817.2 filed Sep. 13, 2005, the contents of which are hereby incorporated by reference in their entirety.

TECHNICAL FIELD

The subject matter of the invention is a method for operating a fuel pump in order to feed fuel from a fuel container to an internal combustion engine, in which method electrical energy in the form of pulses is fed to the fuel pump and the duty cycle is controlled as a function of the fuel requirement of the internal combustion engine. Such controlled fuel pumps are used, in particular, in fuel containers of motor vehicles.

BACKGROUND

A fuel pump which is controlled electronically as a function of the fuel requirement is known from DE 43 02 383 A1. Here, electrical energy is fed in a pulsed form to the fuel pump, wherein the duty cycle is changed as a direct function of a position output signal of an air mass flow rate sensor, wherein the sensor generates the signal as a function of the position of a throttle valve whose position is a measure of the fuel requirement of the internal combustion engine. This method of the regulated pulsed feeding of electrical energy is also known as pulse duration modulation. In particular, electric motors are composed of magnetic or magnetically permeable material which can have magnetostriction effects. Furthermore, they contain current-conducting electrical conductors in magnetic fields which experience a force which corresponds to electric current. If such an electric motor is regulated by means of pulse duration modulation, corresponding alternating forces act on the electrical conductors. In addition, the magnetostriction of the magnetic materials in the alternating magnetic field also brings about an alternating force effect and/or changes in dimensions of these components. Owing to the alternating force effects and the changes in dimensions, the electric motor may be mechanically excited so that sound waves are emitted into the surroundings. If the frequency of the sound waves is in the range of human hearing, the sound waves are perceived as noise. This is generally undesired.

It is therefore generally known to avoid sounds which can be heard by the human ear by selecting a frequency of the duty cycle of the pulse duration modulation outside the range of human hearing, preferably above 20 kHz.

The power loss of power switching transistors of corresponding control electronics is composed of conduction losses and switching losses. While the conduction losses are determined by the voltage drop across the component and the current, the switching losses are determined by the number of switching processes per time unit and the switched current. Depending on the operating parameters of the system to be controlled, the switching losses can significantly exceed the conduction losses. A further disadvantage is that the power loss leads to an increase in temperature of the switching electronics which is manifest as a reduction in the service life of the switching electronics.

SUMMARY

In a method for operating a fuel pump, on the one hand, noises which are disruptive to the user can be avoided and, on the other hand, the power loss of the control electronics may be reduced. According to an embodiment, a method for operating a fuel pump in order to feed fuel from a fuel container to an internal combustion engine, may comprise the steps of: feeding electrical energy in the form of pulses periodically to the fuel pump, controlling the duration of the pulses as a function of the fuel requirement of the internal combustion engine, and controlling the frequency of the pulses in such a way that a higher frequency is set when there is a low delivery rate of the fuel pump than when there is a relatively high delivery rate.

According to a further embodiment, a low delivery rate of the fuel pump may be less than 40% switch-on duration of the operating voltage, preferably less than 30% switch-on duration of the operating voltage, of the fuel pump. According to a further embodiment, when the delivery rate of the fuel pump is low, the frequency may be at least 10 kHz, preferably at least 20 kHz. According to a further embodiment, when the delivery rate is relatively high, the frequency of the pulses may be at a maximum of 50 Hz up to 10 kHz, preferably in the region of 1 kHz. According to a further embodiment, when there is a changeover between a relatively low delivery rate and a relatively high delivery rate of the fuel pump, the frequency may change continuously. According to a further embodiment, when there is a changeover between a relatively low delivery rate and a relatively high delivery rate of the fuel pump, the frequency may be changed suddenly or in a stepped fashion. According to a further embodiment, the current for the fuel pump may be used as a controlled variable for the changes in frequency. According to a further embodiment, the temperature of the control electronics may be used as a controlled variable for the changes in frequency. According to a further embodiment, a combination of the temperature of the control electronics and the current may be used as a controlled variable for the changes in frequency. According to a further embodiment, at least one integral controller can be used for the changes in frequency. According to a further embodiment, a method with generation of sliding mean values can be used for the changes in the frequency.

BRIEF DESCRIPTION OF THE DRAWINGS

The invention will be explained in more detail with reference to an exemplary embodiment. In the drawings.

DETAILED DESCRIPTION

Figure 1:
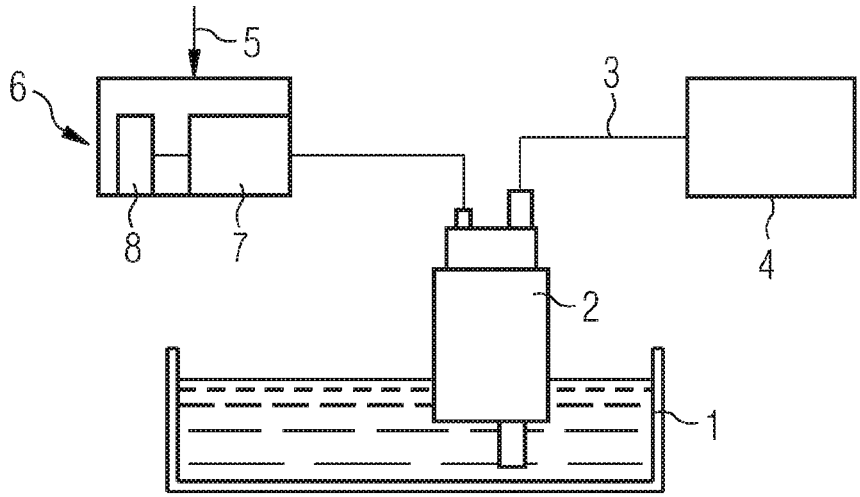
FIG. 1 shows a device which is operated with the method according to an embodiment.

The frequency of the pulses may be controlled in such a way that a higher frequency is set when there is a low delivery rate of the fuel pump than when there is a relatively high delivery rate.

While the delivery rate of the fuel pump is controlled by pulse duration modulation of the electrical energy supplied to the fuel pump, operating the fuel pump with different frequencies of the pulse-shaped energy supply permits the fuel pump to be adapted to various environmental conditions. Operating the fuel pump with a high frequency of the pulse duration modulation when the delivery rate is low causes the fuel pump to run particularly quietly in this operating state since it emits little solid-borne sound owing to magnetic effects. This is desired in particular if the low delivery rate of the fuel pump is accompanied by a low speed of the motor vehicle since, owing to the low travel speed, the travel noises are also low so that loud noises of the fuel pump are perceived as being disruptive.

In contrast, a relatively high delivery rate of the fuel pump occurs only when there is a relatively high fuel requirement of the internal combustion engine. This increased fuel requirement is accompanied by a relatively loud noise of the internal combustion engine, and by corresponding wind noises when the motor vehicle travels at a corresponding speed. Owing to these noises, the noises of the fuel pump are negligible to the effect that even relatively loud noises of the fuel pump can no longer be perceived. The fuel pump can therefore be operated at a relatively low frequency of pulse duration modulation. As a result, owing to the relatively small number of switching processes per time unit, the switching losses for the pulse duration modulation are minimized. As a result, the temperature loading of the control electronics is reduced owing to the lowering of the frequency, which has a positive effect on the service life of the control electronics. The method also has the advantage that it refers not only to a specific system but also can be used for fuel systems with fuel pumps of very different power classes and mechanical or electronic commutation.

A low delivery rate of the fuel pump is, according to this method, less than 40% switch-on duration of the operating voltage, preferably less than 30% switch-on duration of the operating voltage of the fuel pump.

In order to operate the fuel pump when the delivery rate is low, a frequency for pulse duration modulation of at least 10 kHz, preferably at least 20 kHz has proven advantageous. At these frequencies, the electromagnetic or magnetostrictive generation of audible solid-borne sound in the fuel pump is largely avoided so that the fuel pump can be operated so quietly that the noises which are generated in this way cannot be perceived acoustically even in relatively quiet surroundings.

By contrast, the method permits the frequency of the pulse duration modulation to be lowered to 50 Hz to 10 kHz, preferably in the region of 1 kHz, when the delivery rate is relatively high, in which case even 40% switch-on duration of the operating voltage of the fuel pump is considered to be a relatively high delivery rate.

When there is a changeover between a low delivery rate and a relatively high delivery rate of the fuel pump, the change in the frequency can easily take place continuously.

In another advantageous refinement, when there is a changeover between a low delivery rate and a relatively high delivery rate of the fuel pump, the frequency is changed suddenly or in a stepped fashion.

A particularly easy way of controlling the frequency is provided if the frequency is changed as a function of the current. Owing to the load-dependence of the current of the fuel pump, the current constitutes a good controlled variable.

Under certain driving conditions, load changes can occur at very short time intervals. When there is current-dependent frequency control, this can mean that there are equally frequent changes in frequency.

In order to avoid rapid changes in frequency it has proven advantageous to allow the rate of change of the frequency control to be carried out integrally as a function of the current in that at least one integral controller is provided. In particular, rapid changes in current are attenuated by the integral controller since as a result the change in frequency occurs more slowly than the change in current. Another way of controlling the frequency which is also suitable can be carried out by evaluating the temperature of the control electronics. The frequency is changed as a function of the measured temperature of particularly critical components. As a result, the integral controller can be dispensed with because the temperature constitutes the integration of past current loads and is the critical parameter for the control electronics.

If the temperature alone constitutes an excessively slow manipulated variable, a combination of temperature and current can also be used for frequency control.

FIG. 1 is a schematic illustration of the fuel container 1 of a motor vehicle (not illustrated in more detail). A fuel pump 2 which delivers fuel from the fuel container 1 to an internal combustion engine 4 of the motor vehicle via a forward flow line 3 is arranged in the fuel container 1. An electrical signal 5 which is acquired in a known fashion and which constitutes a measure of the instantaneous fuel requirement of the internal combustion engine 4 is fed to control electronics 6 for the fuel pump 2. The control electronics 6 comprise a pulse generator 7 which feeds the current for the fuel pump 2 in the form of pulses to the fuel pump 2. The pulses are fed with constant amplitude, and the pulse duration here is a measure of the supplied electrical energy. In the illustration shown, the control electronics 6 are arranged outside the fuel container 1, for example as a component of the engine controller. However, it is also conceivable to arrange the control electronics 6 on or in the fuel container 1, for example on a flange or in the fuel pump 2. Furthermore, the control electronics 6 comprise an integral controller 8, which, in particular in the case of rapid load changes at the internal combustion engine 4, permits changes in frequencies to occur more slowly than the changes in current.

Figure 2:
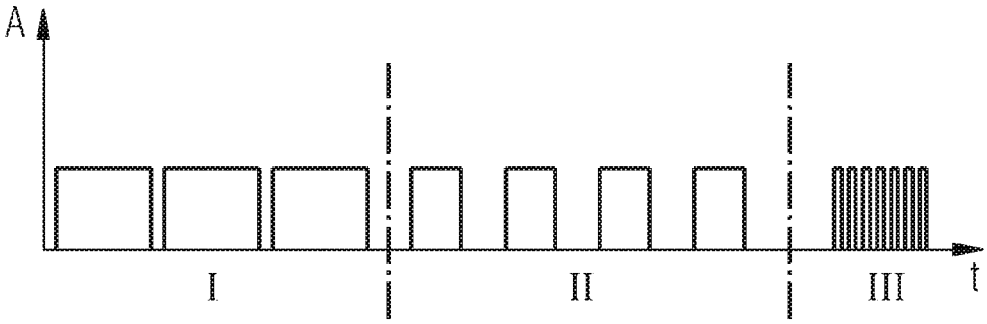
FIG. 2 is a current/time diagram according to the method.

The diagram in FIG. 2 shows, in region I, the current pulses which are generated by the pulse generator 7 for a signal 5 which corresponds to a full load operating mode, i.e. the internal combustion engine is operated with approximately maximum fuel consumption. The pulses are clocked with a relatively low frequency of 1 kHz. In such an operating mode of the internal combustion engine, the noise of the internal combustion engine and the corresponding travel noises are relatively loud so that noises of the fuel pump which are possibly generated by magnetostriction or magnetic forces at this frequency are not perceived.

The region II shows the operation of the internal combustion engine with approximately 60% power. Although the pulse duration of the pulses is correspondingly shorter, the frequency of the pulses is the same as that in region I. In this operating mode of the internal combustion engine, the noises of the internal combustion engine are also louder than the noises of the fuel pump so that in this power range of the internal combustion engine the pulses can also be clocked with a frequency of 1 kHz without the noises of the fuel pump being perceived.

The region III shows the operation of the internal combustion engine in the lower power range which corresponds, for example, to idling or to travel at low rotational speeds. When this travel behavior occurs, the noises of the internal combustion engine and the travel noises are significantly lower than when travel behavior as per region I or region II occurs. The pulses are therefore generated by the pulse generator with a frequency of 20 kHz. This frequency is so high that in the fuel pump no noises are generated in the range of human hearing, with the result that no noises from the fuel pump are perceived in this operating mode of the internal combustion engine either.

What is claimed is:

1. A method for operating a fuel pump having a variable delivery rate in order to feed fuel from a fuel container to an internal combustion engine, the method comprising the steps of:

feeding electrical energy in the form of pulses periodically to the fuel pump, controlling a pulse width as a function of the fuel requirement of the internal combustion engine, and controlling the frequency of the pulses in such a way that an inaudible frequency is set when there is a low delivery rate of the fuel pump but not when there is a relatively high delivery rate, wherein controlling the pulse width and the frequency of the pulses includes transitioning between a plurality of integral operational states, each corresponding to a predefined range of fuel requirement values, including at least:

a first state corresponding to a first range of fuel requirement values, wherein the pulses have a first frequency and a first pulse width;

a second state corresponding to a second range of fuel requirement values, wherein the pulses have the same first frequency but a second pulse width different than the first pulse width; and a third state corresponding to a third range of fuel requirement values, wherein the pulses have a second frequency different than the first frequency, and a third pulse width different than both the first and second pulse widths.

2. The method according to claim 1, wherein a low delivery rate of the fuel pump is less than 40% switch-on duration of the operating voltage, or less than 30% switch-on duration of the operating voltage, of the fuel pump.

3. The method according to claim 2, wherein, when the delivery rate of the fuel pump is low, the frequency is at least 10 kHz, or at least 20 kHz.

4. The method according to claim 1, wherein, when the delivery rate is relatively high, the frequency of the pulses is at a maximum of 50 Hz up to 10 kHz, or in the region of 1 kHz.

5. The method according to claim 1, wherein, when there is a changeover between a relatively low delivery rate and a relatively high delivery rate of the fuel pump, the frequency changes continuously.

6. The method according to claim 1, wherein, when there is a changeover between a relatively low delivery rate and a relatively high delivery rate of the fuel pump, the frequency is changed suddenly or in a stepped fashion.

7. The method according to claim 1, wherein the current for the fuel pump is used as a controlled variable for the changes in frequency.

8. The method according to claim 1, wherein the temperature of the control electronics is used as a controlled variable for the changes in frequency.

9. The method according to claim 1, wherein a combination of the temperature of the control electronics and the current is used as a controlled variable for the changes in frequency.

10. The Method according to claim 7, wherein at least one integral controller is used for the changes in frequency.

11. A fuel pump system for feeding fuel from a fuel container to an internal combustion engine, comprising a fuel pump and an integral controller controlling said fuel pump, wherein the integral controller is operable:

to feed electrical energy in the form of pulses periodically to the fuel pump, to control the duration of the pulses as a function of the fuel requirement of the internal combustion engine, and to control the frequency of the pulses in such a way that an inaudible frequency is set when there is a low delivery rate of the fuel pump but not when there is a relatively high delivery rate, wherein controlling the pulse width and the frequency of the pulses includes transitioning between a plurality of integral operational states, each corresponding to a predefined range of fuel requirement values, including at least:

a first state corresponding to a first range of fuel requirement values, wherein the pulses have a first frequency and a first pulse width;

a second state corresponding to a second range of fuel requirement values, wherein the pulses have the same first frequency but a second pulse width different than the first pulse width; and a third state corresponding to a third range of fuel requirement values, wherein the pulses have a second frequency different than the first frequency, and a third pulse width different than both the first and second pulse widths.

12. The system according to claim 11, wherein a low delivery rate of the fuel pump is less than 40% switch-on duration of the operating voltage, or less than 30% switch-on duration of the operating voltage, of the fuel pump.

13. The system according to claim 12, wherein, when the delivery rate of the fuel pump is low, the frequency is at least 10 kHz, or at least 20 kHz.

14. The system according to claim 11, wherein, when the delivery rate is relatively high, the frequency of the pulses is at a maximum of 50 Hz up to 10 kHz, or in the region of 1 kHz.

15. The system according to claim 11, wherein, when there is a changeover between a relatively low delivery rate and a relatively high delivery rate of the fuel pump, the frequency changes continuously.

16. The system according to claim 11, wherein, when there is a changeover between a relatively low delivery rate and a relatively high delivery rate of the fuel pump, the frequency is changed suddenly or in a stepped fashion.

17. The system according to claim 11, wherein the current for the fuel pump is used as a controlled variable for the changes in frequency.

18. The system according to claim 11, wherein the temperature of the control electronics is used as a controlled variable for the changes in frequency.

19. The system according to claim 11, wherein a combination of the temperature of the control electronics and the current is used as a controlled variable for the changes in frequency.

20. The system according to claim 11, wherein a threshold for switching to said inaudible frequency depends on a noise level generated by said internal combustion engine.

21. The method according to claim 1, wherein a threshold for switching to said inaudible frequency depends on a noise level generated by said internal combustion engine.

* * * * *